United States Patent [19]

Dustmann et al.

[11] 3,988,627

[45] Oct. 26, 1976

[54] ELECTRON SOURCE

[75] Inventors: Cord-Henrich Dustmann, Leopoldshafen; Wolfgang Zernial, Karlsruhe; Helmut Krauth, Hochstetten; Edmund Süss, Staffort, all of Germany

[73] Assignee: Gesellschaft fur Kernforschung m.b.H., Karlsruhe, Germany

[22] Filed: July 14, 1975

[21] Appl. No.: 595,875

[30] Foreign Application Priority Data

July 13, 1974 Germany ..... 2433781

[52] U.S. Cl. ..... 313/309; 313/312; 313/17; 313/22; 313/336; 313/446; 313/459

[51] Int. Cl.[2] ..... H01J 1/02

[58] Field of Search ..... 313/309, 312, 17, 22, 313/24, 25, 360, 361, 36, 446, 459, 336; 328/233; 315/5.39

[56] References Cited

UNITED STATES PATENTS

| | | | |
|---|---|---|---|
| 3,388,740 | 6/1968 | O'Loughlin | 313/32 X |
| 3,489,944 | 1/1970 | Denholm et al. | 315/5.39 |
| 3,706,002 | 12/1972 | Miram et al. | 315/5.39 |
| 3,906,280 | 9/1975 | Andelfinder et al. | 313/351 |

*Primary Examiner*—Saxfield Chatmon, Jr.
*Attorney, Agent, or Firm*—Spencer & Kaye

[57] ABSTRACT

A device for generating a high level electron current pulse includes a housing whose interior can be evacuated from outside the housing, a cathode electrode located in the housing and arranged to be connected to a high voltage generator, an anode electrode disposed in the housing in facing relation to the cathode electrode, the anode electrode having an opening aligned with the electron emission portion of the cathode electrode and being provided with a grid which covers this opening and which presents a high electron transmission level, the grid defining a plane with one face of the anode electrode, and the walls of the housing defining an annular space filled with a solution whose resistivity is a function of its concentration to give these walls a variable electrical resistance which can be adjusted to match the impedance of the cathode electrode - anode electrode system to that of the high voltage generator.

14 Claims, 4 Drawing Figures

ELECTRON SOURCE

BACKGROUND OF THE INVENTION

The present invention relates to an electron generating source including a housing and a cathode which is contacted by a high voltage generator.

In particle accelerators particles are accelerated by electrical fields produced in suitable structures. The energy gain per unit length, which is related to the cost and structure of the accelerators, is limited by the maximum possible field intensity in these structures and, in the case of circular accelerators, additionally by the maximum field intensity of the bending magnets.

Acceleration rates which are greater by several orders of magnitude can be expected with collective accelerators in which space charge fields of as great a density as possible are utilized for the acceleration. One type of collective accelerator which has been proposed and which is presently the subject of research, is the electron ring accelerator in which the desired high acceleration fields are generated by the formation of a ring of electrons of a very high charge density. Such an accelerator is described in a paper by H. Schopper in Physical Reports No. 24, pages 201,255 (1968).

In order to fully realize the advantages of the electron ring accelerator, the maximum field intensity at the edge of the ring must be about 100 MV/m. This resultas in requirements for special performance levels for the electron ring accelerator as well as requirements for the injector needed for the accelerator, e.g. an electron current of at least 400 A at an emittance of 0.1 cmrad with an energy of 2 MeV and a pulse duration of several nanoseconds. Similar beam requirements also exist for electron beam pumped high energy lasers.

In a known arrangement, such as the Febetron Type 705 manufactured by Field Emission Corp., a 160-stage Marx generator with a stored energy of 800 J is accomodated in a pressure tank and furnishes an output pulse of 2.3 MV at a maximum load voltage of 35 kV to 400 Ω at a half value of ~ 50 nsec. The diode employed, which is composed of a cathode electrode - anode electrode system, includes a molten glass tube, 24 tungsten tips as the field emission cathode, a titanium window of a thickness of 25 $\mu$ or 70 $\mu$ as the anode, and an internal magnet which focusses the electrons through the titanium window.

The beam quality of this diode is such that at an emittance of 0.1 cmrad, of the 6 kA total current only 40 to 50 A, or 30 A, can be utilized. After an average of 100 or 500 pulses, depending on the titanium window thickness, the titanium window is shot through and the glass is damaged by the electron bombardment.

The geometric arrangement of the cathode with respect to the anode, the internal solenoid being also at anode potential, also requires a distribution of the electrical field which leads to wide angles and thus to poor beam quality. Therefore, the internal solenoid and thus the magnetic focussing are useless. Furthermore, the titanium window leads to bulging of the beam as a result of multiple dispersion.

SUMMARY OF THE INVENTION

It is an object of the present invention to provide an electron source which is capable of producing pulses of, for example, more than 400 A at an emittance of 0.1 cmrad for periods of time of the order of magnitude of nanoseconds.

A further object of the invention is to eliminate the need for magnetic focussing devices for the electron beam.

Another object of the invention is to eliminate the need for a window, which would produce dispersion of the electrons.

A further object of the invention is to provide a source in which the space around the cathode-anode system can be evacuated from the outside.

Another object of the invention is to enable the diode impedance to be matched to the high voltage generator.

These and other objects are accomplished, according to the present invention by the provision of a source including a housing that can be evacuated from the outside, and a cathode electrode disposed opposite an anode electrode provided with a grid which permits electrons emanating from the cathode electrode to pass and which forms a plane with the anode electrode, the walls of the housing being designed as a variable resistance for the matching of the impedance of the cathode electrode - anode electrode system to the high voltage generator.

According to a further feature of the invention, the cathode electrode is designed so that its surface has the shape of an equipotential surface of a plate capacitor.

In one embodiment of the source of the present invention, the housing is designed as a double-walled tube, the space between the walls is filled with a liquid solution through at least one inlet and outlet and a change in the concentration of the solution varies the electrical resistance of the housing. The solution may be circulated continuously in a closed circuit through a reservoir.

In a further embodiment of the invention, the inner walls of the tube are made of rings whose surfaces which point into the interior of the tube are provided with a continuous sawtooth profile and the individual rings are separated from one another by electrically conductive intermediate plates which are in contact with the solution in the interstice of the tube.

According to a preferred embodiment of the source of the invention, the cathode electrode is disposed on the axis of the tube at a frontal cover and can be displaced in the axis. Furthermore, the anode electrode may form the end face of a cylinder extending into the tube, the cylinder being fastened to a flange at the other frontal face of the tube and the end face may be provided with an opening which is closed by an anode grid, the grid lying opposite the frontal face of the cathode electrode. The cathode electrode may here be connected to the frontal face cover via an electrode mount while the electrode mount itself provides a means for adjusting the cathode electrode in the direction of the tube axis. The center plane between the cathode and anode surfaces is perpendicular to the axis of the tube.

In a particularly preferred embodiment of the invention, the housing or the tube can be evacuated through the grid of the anode electrode.

A further embodiment of the source of the present invention is distinguished by a field emission cathode which is inserted in the cathode electrode surface and which is composed of a bundle of needles the tips of which lie in a plane parallel to the center plane.

DESCRIPTION OF THE PREFERRED EMBODIMENTS

Figure 2:
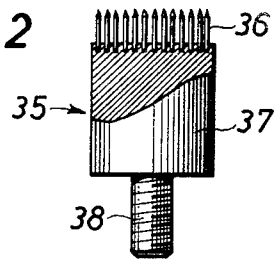
FIG. 2 is a partly broken-away detail view of one element of the source of FIG. 1.
Figure 1:
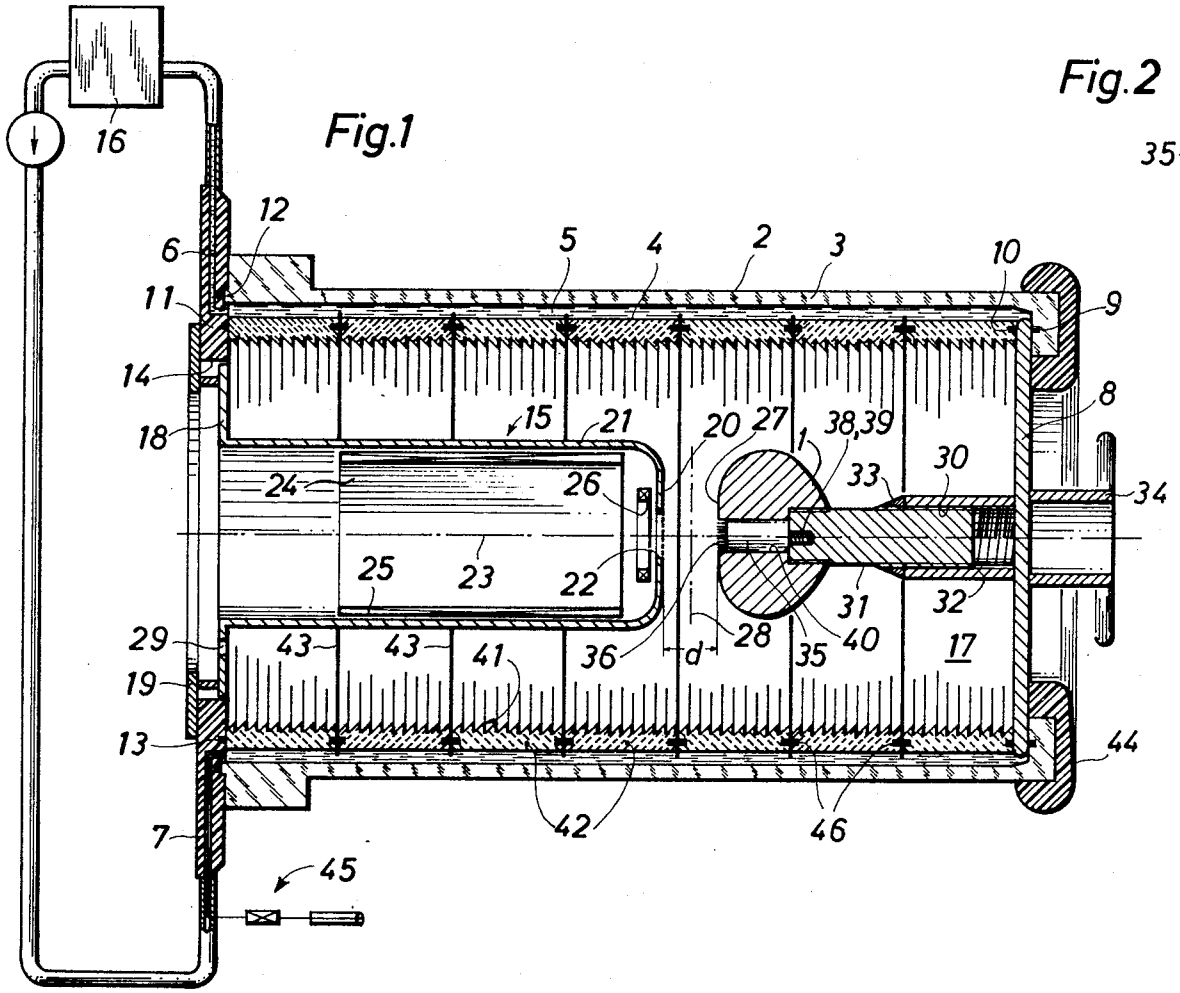
FIG. 1 is a cross-sectional elevational view of a preferred embodiment of a source according to the invention.

As is known, a Marx generator (not shown in detail) has an internal resistance of, for example, 400 Ω so that with desired matching of the load resistance composed of an anode electrode - cathode electrode arrangement, and for a given voltage of about 2 MV, the total load current must inevitably be 5 kA. Since the space charge forces decrease in proportion to $1/\gamma^2$, where $$\gamma = \left(1 - \frac{v^2}{c^2}\right)^{-1/2};$$

$v$ being the velocity of the electrons and $c$ being the velocity of light, high current density near the cathode 1, where $\gamma$ is still very small, would lead to wide angles as a result of space charge ejection. For this reason housing 2 is provided with a variable resistance.

Housing 2 consists of a cylindrical tube with double walls. The outer wall 3 is made of an insulating material and has an inner diameter which is somewhat greater than the outer diameter of the inner wall 4 so that a space 5 is present between the two walls 3 and 4. This space is in communication with an inlet line 6 and an outlet line 7.

One frontal face of tube 2 is formed by a frontal face cover 8 of electrically conductive material which is held by the two walls 3 and 4. The seal for space 5 is produced by two sealing rings 9 and 10. The other frontal face of tube 2 is formed by a flange 11 which is screwed to the outer wall 3 and which seals space 5 off from the environment and the interior by means of sealing rings 12 and 13. The flange 11 itself has an inner bore 14 which is occupied by an anode electrode system 15 to be described below.

An aqueous $CuSO_4$ salt solution is filled into space 5. In order to provide cooling and easily change the resistance value formed by this liquid, by varying the concentration of salt in the solution, the solution is continuously circulated in closed circuit through a reservoir 16. The adjustability of the resistance of the solution always permits matching of the diode impedance to the Marx generator (not shown in detail) or to another generator independently of the existing electron current value. Reservoir 16 contains a resistance measuring device operating with AC voltage which indicates whether distilled $H_2O$ should be added to increase the resistance or whether pure $CuSO_4$ should be added to decrease the resistance of the solution. Distilled $H_2O$ and $CuSO_4$ can be added manually or automatically.

The anode electrode 15 is composed of a cylinder extending into the interior 17 of the tube 2 and provided with an edge 18 which can be screwed to flange 11 through the intermediary of a flange 19. The actual anode electrode is defined by the frontal face 20 of the cylinder 15, this frontal face 20 having a rounded area leading to the cylinder sleeve 21. Frontal face 20 is provided with a central bore 22 the center of which lies on the central axis 23 of housing 2. Opening 22 is closed by a grid. The grid itself, in this embodiment, is formed of a $V_2A$ steel fabric of 22 $\mu$ wire with meshes, or openings, of 500 $\mu$, so that an optical transmission of 96% is realized, i.e. 96% of all electrons can pass through anode grid 22 without difficulty. $V_2A$ is a steel of the composition: 18 % Cr, 8 % Ni, 0.12 % C [A ISI 302]; 18 % Cr, 9 % Ni, 0.05 % C [A ISI 304] or 18 % Cr, 9 % Ni, ≥ 0.5 % Ti and 0.1 % C [A ISI 321].

Within the anode chamber 24, control coils 25 or Rogowski coils 26, respectively, may be disposed, but these are not, however, required to generate or guide the electron current and are provided for measuring purposes. The anode material is also a $V_2A$ steel, representing a compromise between the requirements for high voltage electrodes on the one hand and the workability and availability of the material on the other hand. It is also conceivable, however, to make the electrodes, i.e. the anode electrode 15 as well as the cathode electrode 1, of tungsten or some other heavy metal.

High voltage resistance and operational dependability are decisive for the configuration of the cathode electrode 1. It must be assured that no electrons impinge on the vacuum vessel walls and there produce damage after extended operation. Since the highly polished cathode electrode surface 27 is much more likely to produce faulty electron emissions than the anode electrode 20, 22, the center plane 28 between the cathode electrode 1 and the anode electrode 15, 20, 22 is positioned nearer to the frontal face cover 8 than to the flange 11 and thus the field intensity between the cathode electrode 1 and wall 4 is reduced.

The cathode electrode surface 27 in the immediate vicinity of the cathode is planar and parallel to the plane formed by the frontal face 20 and the anode electrode grid 22. The distance $d$ between the cathode electrode and the anode electrode is variable between 0 and 55 mm by means of fine threads 30 at the neck 31 of the cathode electrode 1 and at the cathode electrode mount 32 and is held stationary by means of a counternut, or locking nut, 33, which simultaneously covers threads 30 so that no electron emission can occur from the thread peaks. With respect to the high voltage, the cathode electrode 1 is connected to the high voltage contact 34, which itself may be connected to the high voltage generator (not shown in detail). The axis of the cathode electrode is identical with the axis 23 of tube 2.

A cathode is provided in the cathode electrode surface 27 to serve as the field emission cathode 35. It includes a bundle of more than 200 tungsten needles 36 the tips of which lie in a plane. The needles 36 are soldered into a base 37 which is provided with a threaded shank 38 to be screwed into a counterthreaded bore 39 in the tip of neck 31 so that it is held firmly. The cathode 35 fits precisely into a recess 40 in electrode 1. The cathode itself is shown in detail in the cross-sectional view of FIG. 2.

The tube 2 can be evacuated from the outside through anode grid 22 and additional holes 29 in flange 18. This is important also because cathode 1 and anode grid 22 should always be accessible for replacement.

In order to insulate the surfaces of the individual rings 42 which form the inner wall 4 and to insulate the acceleration path d between cathode 1 and anode 22, 20, a pressure of $P < 10^{-5}$ Torr is required. The electrons emitted by cathode 1, 36 ionize the residual gas molecules in the tube 2 so that the cathode electrode 27, 36 is bombarded with electrons in proporton to the pressure. However, due to the short pulse duration, the acceleration paths for the ions are only very short and thus the energy of the ions is low. It has been found that damage to the electrode parts 1, 20, 22, 27, 36 will no longer occur once the pressure is reduced to $P = 5 \cdot 10^{-6}$ Torr. In order to be able to reach such a pressure, the rings 42 are made of low pressure polyethylene or an $Al_2O_3$ ceramic.

Since a voltage of more than 2 MV must be safely insulated within tube 2, the breakdown field intensity along the surface 41 of the rings 42 must be considered. The breakdown field intensity depends on the material, the surface configuration and the path length so that a sawtooth profile with 30° tooth angles was selected for the interior of the rings 42. Since the breakdown field intensity does not increase linearly with length, the entire axial length of the tube is divided by discs 43 made of $V_2A$ steel and of a thickness of 0.5 mm, which discs are in electrical contact with the $CuSO_4$ resistor 5 and thus are kept at a defined potential, thereby controlling the potential drop along each of rings 42. Furthermore, the rings 42 discharge any possibly present surface charges. With these measures the applied voltage can safely be insulated. If local discharges occur, for example from electron bombardment, the discs 43 prevent an avalanche type total breakthorugh. Rings 42 and discs 43 are sealed against the interior 5 which is filled with the $CuSO_4$ solution and the interior 17 of the tube.

Toward the outside, the tube 2 is insulated by transformer oil. However, it is necessary to provide the upper edge of tube 2 with a spray guard 44 since otherwise the outer tube 3, which is made of plastic, would be damaged by spray discharges from the $CuSO_4$ salt solution into the oil and the seal would thus be destroyed.

The anode electrode 15, 20, 22 forms a plane with grid 22 which has a rounded edge with a radius of curvature of 2 cm. The diameter of the anode electrode is selected to be large enough so that all of the electrons emitted by cathode 35, 36 impinge on the anode 20, 22 and not on the walls of the vacuum vessel. The anode 20, 22 has a diameter of about 12 cm.

In order to monitor the time dependence of the pulse voltage in space 5, there is provided a device 45 which includes a voltage divider and an input probe inserted in a sealed manner into line 7 to be in communication with the solution.

Figure 4:
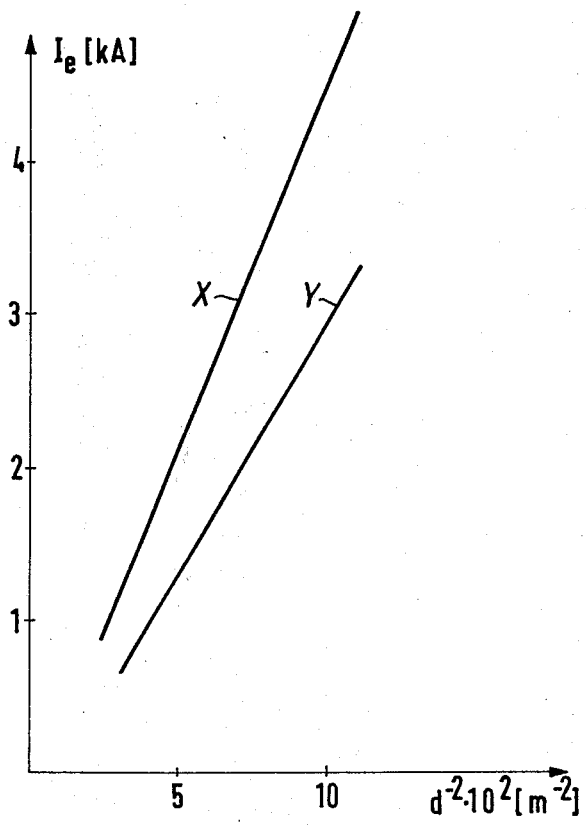

The current drawn from cathode 35, 36 can thus be made as high as 5 kA by varying the distance d, the precise relation being shown in FIG. 4.

Figure 3:
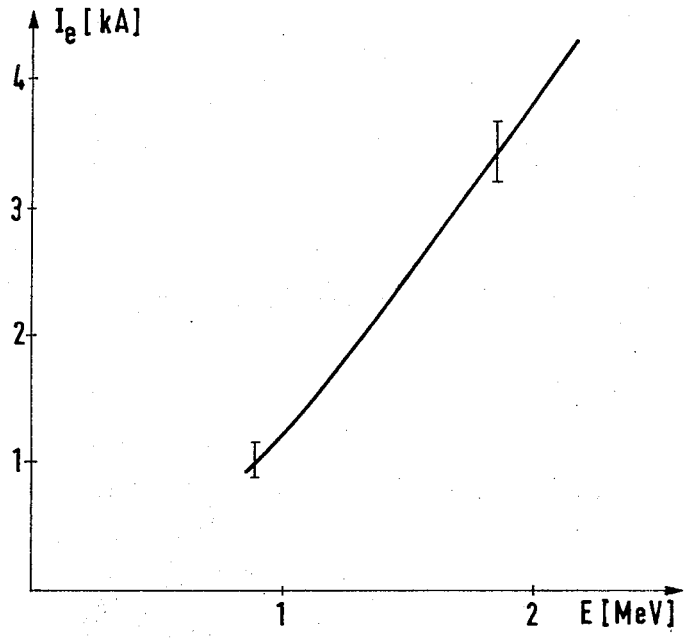
FIGS. 3 and 4 are performance graphs used in explaining the performance of a source according to the invention.

To describe the diode properties of the source, it is necessary to consider the characteristics of this system. For this purpose, the characteristic curve $I_e$ $(\phi)_0$ of diode 1, 15 was measured for a cathode electrode - anode electrode distance of $d = 38$ mm and plotted in FIG. 3 as a function of the energy in MeV. The current was measured in kA.

FIG. 4 shows the measured dependence of the emission current $I_e$ in kA on $d^{-2}$ for $\phi_0 =$ constant. Curve X here applies to a $\phi_0$ of 2 MV and curve Y to a $\phi_0$ of 1.5 MV. $\phi_0$ is the applied maximum voltage.

It will be understood that the above description of the present invention is susceptible to various modifications, changes and adaptations, and the same are intended to be comprehended within the meaning and range of equivalents of the appended claims.

What is claimed is:

1. A source for generating electrons comprising: a housing; a cathode electrode located in said housing and arranged to be connected to a high voltage generator; means permitting the interior of said housing to be evacuated from the outside; an anode electrode disposed in said housing facing, and spaced from, said cathode electrode; a grid associated with said anode electrode and arranged to permit electrons emanating from said cathode electrode to pass therethrough, said grid defining a plane with one face of said anode electrode; means constituting part of the walls of said housing to give such walls a variable electrical resistance which is adjustable to match the impedance of the cathode electrode-anode electrode system to that of the high voltage generator; a cylinder extending into said housing, said anode electrode forming one end face of said cylinder, and a flange located at one end of said housing and supporting said cylinder, said one end face of said cylinder being provided with an opening closed by said anode grid, said grid being disposed opposite the frontal face of said cathode electrode.

2. Source as defined in claim 1 wherein said tube comprises, at the other end thereof, a frontal cover plate and said cathode electrode is centered in the axis of said tube and is mounted on said frontal cover plate, and means supporting said cathode electrode for displacement in the direction of said tube axis.

3. Source as defined in claim 1 further comprising deflection means mounted at the interior of said cylinder.

4. Source as defined in claim 3 wherein said deflection means are constituted by control coils.

5. A source for generating electrons comprising: a housing; a cathode electrode located in said housing and arranged to be connected to a hgih voltage generator; means permitting the interior of said housing to be evacuated from the outside; and anode electrode disposed in said housing facing, and spaced from, said cathode electrode; a grid associated with said anode electrode and arranged to permit electrons emanating from said cathode electrode to pass therethrough, said grid defining a plane with one face of said anode electrode; and means constituting part of the walls of said housing to give such walls a variable electrical resistance which is adjustable to match the impedance of the cathode electrode-anode electrode system to that of the high voltage generator; wherein said housing comprises, at one end thereof, a frontal cover plate and said cathode electrode is centered in the axis of said tube and is mounted on said frontal cover plte, and means supporting said cathode electrode for displacement in the direction of said tube axis, and comprising an electrode mount permitting displacement of said cathode electrode in the direction of the axis of said tube.

6. A source for generating electrons comprising:

a. a housing, said housing comprising a double-walled tube presenting a space between its walls, means defining at least one liquid inlet and outlet communicating with the space, and a liquid solution having a resistivity which is a function of its concentration and filling the space between said tube walls, the concentration of said solution being variable for giving the walls of said housing a variable electrical resistance which is adjustable to match the impedance of the cathode electrode-anode electrode system to that of a high voltage generator;

b. a cathode electrode located in said housing and arranged to be connected to such high voltage generator, said cathode electrode being shaped so that its exterior surface has the shape of an equipotential surface of a plate capacitor;

c. means permitting the interior of said housing to be evacuated from the outside;

d. an anode electrode disposed in said housing facing, and spaced from, said cathode electrode; and e. a grid associated with said anode electrode and arranged to permit electrons emanating from said cathode electrode to pass therethrough, said grid defining a plane with one face of said anode electrode.

7. Source as defined in claim 6 further comprising a reservoir connected between said inlet and outlet for permitting said solution to be continuously circulated in a closed circuit.

8. Source as defined in claim 6 further comprising means including a voltage divider having an input located in said liquid inlet or outlet fro measuring the time dependence of the pulse voltage in the space between anode and cathode.

9. Source as defined in claim 6 wherein the median plane between said cathode electrode and anode electrode surfaces is perpendicular to the axis of said tube.

10. Source as defined in claim 6 wherein said cathode electrode includes a field emission cathode inserted into the cathode electrode surface, said field emission cathode comprising a bundle of more than 100 tungsten needles whose tips lie in a plane which is parallel to the median plane between said cathode electrode and anode electrode surfaces.

11. Source as defined in claim 6 wherein said means permitting the interior of said housing to be evacuated are arranged to permit such evacuation to occur through said grid associated with said anode electrode.

12. Source as defined in claim 6 wherein said housing is arranged to be immersed in oil.

13. Source as defined in claim 6 wherein the outer walls of said housing are made of an electrically insulating material.

14. Source as defined in claim 6 further comprising spray protection means disposed at the high voltage edges of said housing.

* * * * *